US006733639B2

(12) United States Patent
Busse et al.

(10) Patent No.: US 6,733,639 B2
(45) Date of Patent: May 11, 2004

(54) ELECTRODE

(75) Inventors: Bernd Busse, Darmstadt (DE); Lars-Erik Bergman, Ljungaverk (SE)

(73) Assignee: Akzo Nobel N.V., Arnhem (NL)

( * ) Notice: Subject to any disclaimer, the term of this patent is extended or adjusted under 35 U.S.C. 154(b) by 362 days.

(21) Appl. No.: 10/037,070

(22) Filed: Nov. 9, 2001

(65) Prior Publication Data

US 2002/0110726 A1 Aug. 15, 2002

Related U.S. Application Data

(60) Provisional application No. 60/247,567, filed on Nov. 13, 2000.

(51) Int. Cl.[7] ..... C25B 11/03

(52) U.S. Cl. ..... 204/283; 204/290.01; 204/290.03; 204/290.05; 204/290.06; 204/290.11; 204/290.12; 204/290.14; 205/508; 205/510; 205/618; 205/620; 205/621

(58) Field of Search ..... 204/283, 290.01, 204/290.03, 290.05, 290.06, 290, 8, 290.11, 290.12, 290.14; 205/508, 510, 618, 620, 621

(56) References Cited

U.S. PATENT DOCUMENTS

| | | | | | |
|---|---|---|---|---|---|
| 3,234,110 | A | | 2/1966 | Beer | 204/38 |
| 3,930,094 | A | * | 12/1975 | Sampson et al. | 442/365 |
| 4,518,705 | A | * | 5/1985 | Solomon et al. | 502/101 |
| 4,568,442 | A | * | 2/1986 | Goldsmith | 204/284 |
| 4,578,159 | A | | 3/1986 | Miles et al. | 204/98 |
| 4,647,351 | A | * | 3/1987 | Gelb | 205/343 |
| 4,787,964 | A | * | 11/1988 | Gordon et al. | 204/282 |
| 4,980,037 | A | * | 12/1990 | Hossain et al. | 205/768 |
| 5,203,978 | A | | 4/1993 | Tsou et al. | 204/252 |
| 5,242,765 | A | * | 9/1993 | Naimer et al. | 429/42 |
| 5,618,392 | A | * | 4/1997 | Furuya | 204/252 |
| 5,693,213 | A | * | 12/1997 | Shimamune et al. | 205/510 |
| 5,879,521 | A | * | 3/1999 | Shimamune et al. | 204/252 |
| 5,938,901 | A | | 8/1999 | Shimamune et al. | 204/283 |
| 6,010,606 | A | * | 1/2000 | Denton et al. | 204/284 |
| 6,127,061 | A | * | 10/2000 | Shun et al. | 429/40 |
| 6,368,473 | B1 | * | 4/2002 | Furuya et al. | 204/263 |
| 6,423,194 | B1 | * | 7/2002 | Furuya | 204/284 |
| 6,547,947 | B1 | * | 4/2003 | Uno et al. | 205/466 |

FOREIGN PATENT DOCUMENTS

| | | | |
|---|---|---|---|
| EP | 582 333 | 2/1994 | H01M/4/86 |
| GB | 43 12 126 | 10/1994 | G01N/27/40 |

OTHER PUBLICATIONS

Abstract of DE 43 12 126 from EPO on–line data base esp@cenet, Oct. 1994.

European Searcn Report EP 00 85 0191, dated Apr. 9, 2001.

* cited by examiner

*Primary Examiner*—Bruce F. Bell
(74) *Attorney, Agent, or Firm*—Lainie E. Parker

(57) ABSTRACT

The invention relates to a gas diffusion electrode (1) comprising a hydrophobic gas diffusion layer (3*b*), a reaction layer (3*a*), and a hydrophilic layer (5) arranged in the mentioned order wherein the reaction layer (3*a*) is arranged to a barrier layer (4), which barrier layer (4), on its opposite side, is arranged to the hydrophilic layer (5). The invention also relates to a method for manufacturing such a gas diffusion electrode (1), and to an electrolytic cell, and use thereof.

13 Claims, 2 Drawing Sheets

ELECTRODE

This application claims priority of U.S. Provisional Patent Application No. 60/247,567, filed Nov. 13, 2000.

The present invention relates to a gas diffusion electrode suitable for production of chlorine and alkali metal hydroxide. The invention also concerns a method for manufacturing such a gas diffusion electrode. The invention further concerns an electrolytic cell comprising such gas diffusion electrode and the use thereof.

BACKGROUND OF THE INVENTION

Electrolysis of alkali metal chlorides to produce chlorine and alkali metal hydroxide has been known for a long time.

In the past, hydrogen evolving cathodes have been used for this purpose. The principal chemical reaction taking place in the electrolytic cell can be represented by the following scheme: $2NaCl+2H_2O \rightarrow Cl_2+2\ NaOH+H_2$. This electrolysis reaction, having a theoretical cell voltage of 2.24 V, requires a considerable amount of energy.

Previously, also oxygen consuming gas diffusion electrodes have been disclosed for the production of chlorine and alkali metal hydroxide, as further described in e.g. U.S. Pat. No. 4,578,159. The term "gas diffusion electrode", as used herein, relates to an electrode, comprising a hydrophobic gas diffusion layer and a reaction layer, and suitably an electrode substrate, to which gas diffusion electrode oxygen-containing reactant gas is supplied to undergo electrolysis. Electrolyte is supplied to one area of the electrode, different from the area to which reactant gas is supplied. The principal reaction taking place at the reaction layer of the electrode may be represented by the following reaction scheme: $2NaCl+H_2O+\frac{1}{2}O_2 \rightarrow Cl_2+2NaOH$, the theoretical cell voltage being 0.96 V, i.e. only about 40% of the cell voltage of the hydrogen evolving electrode. Therefore, the gas diffusion electrode considerably reduces the energy costs of the operation of the electrolytic cell.

In previously employed partitioned electrolytic cell arrangements, wherein gas diffusion electrodes have been directly contacted to an ion exchange membrane, dividing the electrolytic cell into a cathode compartment and an anode compartment, electrolyte flooding problems have been faced due to the fact that the diffusion of oxygen-containing gas supplied to the gas diffusion electrode has been impeded by electrolyte present in the cathode compartment. This problem can, however, be overcome by arranging a hydrophilic layer between the reaction layer and the ion exchange membrane, thereby providing a flood-preventing gap in between.

In this type of electrode arrangements, however, it has been noticed that the catalytic material present in the reaction layer of the electrode in contact with the hydrophilic layer, undesirably catalyses an oxidation reaction of the hydrophilic layer, usually comprising carbon, which causes formation of carbonates. Carbonates, in turn, undesirably increase the hydrophilicity of the hydrophobic gas diffusion layer, leading to a decreased diffusion of supplied gas to the reaction layer of the electrode. This fact results in an increase of the cell voltage and destabilises the operation of the electrolytic cell.

The present invention intends to solve the above problems.

THE INVENTION

The present invention relates to a gas diffusion electrode comprising a hydrophobic gas diffusion layer, a reaction layer, a barrier layer, and a hydrophilic layer, arranged in the mentioned order.

It has been surprisingly found that the problems referred to above concerning unwanted catalytic oxidation of the material in the hydrophilic layer can be solved by providing a barrier layer between the hydrophilic and reaction layers. The barrier layer thus provides a barrier preventing unwanted oxidation processes to occur by impeding contact between the two layers. The barrier layer also secures stable operation of the electrolytic cell, in which the gas diffusion electrode is arranged, thereby preventing any substantial fluctuation in cell voltage or current density. Moreover, it has been found that the inventional gas diffusion electrode can be operated substantially without any other deteriorating effects. The barrier layer further provides good adhesion to its adjacent layers.

According to one preferred embodiment, the hydrophobic gas diffusion layer is arranged to one side of an electrode substrate. The electrode substrate is further, on its opposite side, suitably arranged to the reaction layer.

The hydrophobic gas diffusion layer is suitably made of silver, or silver-plated metals, e.g. silver-plated nickel, and hydrocarbon polymers such as vinyl resins, polyethylene, polypropylene, or other hydrocarbon polymers; halocarbon polymers containing chlorine, fluorine, or both, including fluoropolymers such as polytetrafluoroethylene (PTFE), fluorinated ethylene-propylene copolymer (FEP), polychlorofluoroethylene or mixtures thereof, preferably PTFE. The polymers suitably have a molecular weight of 10,000 g/mole or more.

The reaction layer suitably comprises at least one catalytically active material for the production of alkali metal hydroxide. The material may include silver, platinum, platinum group metals, or mixtures thereof, preferably platinum, silver or mixtures thereof. Also a polymeric binder may be included in the reaction layer such as polytetrafluoroethylene (PTFE), fluorinated ethylene-propylene copolymer (FEP), fluoro polymers such as nafion™ (perfluorocarbon sulfonic acid resin) and derivatives thereof, or other halocarbon polymers such as polychlorofluoroethylene or mixtures thereof, preferably polytetrafluoroethylene (PTFE) or nafion™ or mixture or derivatives thereof.

According to one preferred embodiment, the reaction layer is arranged to the electrode substrate on the opposite side of the hydrophobic gas diffusion layer. The electrode substrate is suitably made of a conductive expanded metal, a mesh or the like. The substrate material may be silver or silver plated metals such as silver plated stainless steel, silver plated nickel, silver plated copper, gold, gold plated metals such as gold plated nickel, or gold plated copper; nickel, cobalt, cobalt plated metals such as cobalt plated copper, or mixtures thereof, preferably silver or silver plated metals. Polymers such as halocarbon polymers can also be incorporated in the electrode substrate as very finely divided particulate solids, e.g. micron-sized particles.

By barrier layer, is meant to include any layer comprising a material functioning as a layer separating the hydrophilic and reaction layers, thereby preventing contact between the hydrophilic and the reaction layer, especially to impede the catalyst particles in the reaction layer to catalyse the oxidation of carbon present in the hydrophilic layer to form carbonates. The barrier layer suitably is substantially made of a ceramic material such as zirconium oxides, e.g. zirconia ($ZrO_2$), titanium oxides, e.g. $TiO_2$, $Ti_4O_7$, and hafnium oxides, e.g. $HfO_2$, or mixtures thereof, preferably of zirconia ($ZrO_2$) or mixtures thereof. Further suitable barrier materials include other materials resistant to alkaline environment, such as SiC, BN, TiN, $SiO_2$. Binder material such as PTFE or nafion™ or the like may also be mixed with ceramic or barrier materials to form a barrier layer, suitably forming a barrier layer comprising less than 30 wt % binder material.

The hydrophilic layer is suitably a porous material resistant to electrolytes present in the cathode compartment e.g. alkaline solutions such as caustic soda or the like. Suitably, the hydrophilic layer comprises carbon such as carbon cloth, porous carbon, sintered carbon, or mixtures thereof. The hydrophilic layer is suitably, on the opposite side of the barrier layer, arranged to a separator partitioning an electrolytic cell into a cathode compartment, containing the gas diffusion electrode, and an anode compartment.

According to one preferred embodiment, the layers of the gas diffusion electrode of the invention are arranged to one another by means of coating.

According to a further preferred embodiment, the inventional gas diffusion electrode comprises an electrode substrate made of a silver mesh substrate, a silver paste mixture comprising silver powder and PTFE sintered to the substrate, a reaction layer arranged to one side thereof comprising a silver and/or platinum layer, on which reaction layer is deposited a barrier layer of 70 wt % $ZrO_2$ powder mixed with a 30 wt % PTFE, nafion™, or mixtures thereof to which barrier layer a hydrophilic layer is arranged. A conventional hydrophobic gas diffusion layer is arranged to the opposite side of the reaction layer.

Any other embodiment of a gas diffusion electrode, suitably an oxygen depolarised gas diffusion electrode, provided with a barrier layer as above described also is part of the this invention, e.g. semihydrophobic, liquid or gas permeable gas diffusion electrodes.

The invention also relates to a method for manufacturing a gas diffusion electrode comprising arranging a hydrophobic gas diffusion layer, a reaction layer, a barrier layer and a hydrophilic layer to each other in the mentioned order.

The layers of the gas diffusion electrode are preferably arranged one to the other by means of coating.

According to one preferred embodiment, the method comprises arranging the hydrophobic gas diffusion layer to one side of an electrode substrate, and arranging the reaction layer to the opposite side of said electrode substrate. Preferably, the hydrophobic gas diffusion layer and the reaction layer are arranged to the electrode substrate by means of coating.

According to yet a further preferred embodiment of the invention, the method for manufacturing the gas diffusion electrode comprises:

1) providing a substrate, suitably by spreading a powder paste over a net, paste is subsequently sintered to the net at a temperature of suitably from about 150° C. to about 500° C., preferably from about 200 to about 240° C., thereby providing an electrode substrate;
2) applying an electrocatalytic powder paste and/or solution on one side of the electrode substrate to form a reaction layer, and a gas diffusion hydrophobic layer on the opposite side thereof, and optionally simultaneously applying a binder solution on both sides of the substrate. The electrocatalytic powder paste and/or solution and the optional binder solution is suitably baked at a temperature from about 100 to about 120° C.
3) applying a barrier layer to the reaction layer; and
4) arranging a hydrophilic layer to the barrier layer.

Suitably, the powder paste of step 1 is silver powder paste, gold powder paste, or mixtures thereof, preferably silver paste. The net, on which the powder paste is sintered, is suitably made of silver or silver plated metals such as silver plated stainless steel, silver plated nickel, silver plated copper, gold, gold plated metals such as gold plated nickel, gold plated copper; nickel, cobalt, cobalt plated metals such as cobalt plated copper, or mixtures thereof, preferably silver or silver plated metals. The optionally applied binder solution of step 2 suitably is polytetrafluoroethylene (PTFE), fluoro polymers such as nafion™ or derivatives thereof, which suitably comprise perfluorocarbon sulfonic acid type resin, fluorinated ethylene-propylene copolymer (FEP), or other halocarbon polymers such as polychlorofluoroethylene or mixtures thereof, preferably polytetrafluoroethylene (PTFE), preferably nafion™. The applying of an electrocatalytic powder paste and/or solution can also be performed simultaneously with step 1 or 3. To impart good affinity avoiding direct contact between the reaction layer and the hydrophilic layer, the reaction layer is provided with a barrier layer of e.g. $ZrO_2$.

The obtained gas diffusion electrode structure is subsequently arranged to a hydrophilic layer, which hydrophilic layer is suitably directly arranged to a separator partitioning the cathode and anode compartments of an electrolytic cell.

The invention further concerns an electrolytic cell comprising an anode compartment and a cathode compartment partitioned by a separator, wherein an anode is arranged in the anode compartment and the above described gas diffusion electrode is arranged in the cathode compartment. Any suitable anode may be employed in the anode compartment. The gas diffusion electrode may be arranged as plural belt-shaped electrode members or in an electrode patchwork configuration, as further described in U.S. Pat. No. 5,938,901.

The separator, suitably is a commercially available ion exchange membrane, such as Nafion™, preferably a cation exchange membrane, made of a solid polymer electrolyte that transfers ionic charge due to fixed ion exchange groups attached to backbone chains. The membrane used suitably is an inert, flexible membrane, substantially impervious to hydrodynamic flow of the electrolyte and the passage of gas products produced in the cell. The ion exchange membrane may comprise a perfluorinated backbone coated with attached fixed ionic groups such as sulphonic or carboxylic radicals. The terms "sulfonic" and "carboxylic" are meant to include salts of sulfonic and carboxylic acids which are suitably converted to or from the acid groups by processes such as hydrolysis. Also non-perfluorinated ion exchange membranes or anion exchange membranes comprising quaternary amines on a polymeric support may be used.

The invention also concerns a process for the production of chlorine and alkali metal hydroxide in an electrolytic cell as described above comprising a) supplying an oxygen-containing gas to the cathode compartment
b) supplying an aqueous solution of alkali metal chloride to the anode compartment
c) passing an electric current through the cell from the anode to the gas diffusion electrode thereby forming alkali hydroxide and in the cathode compartment and chlorine in the anode compartment.

DESCRIPTION OF THE EMBODIMENTS

Figure 1:
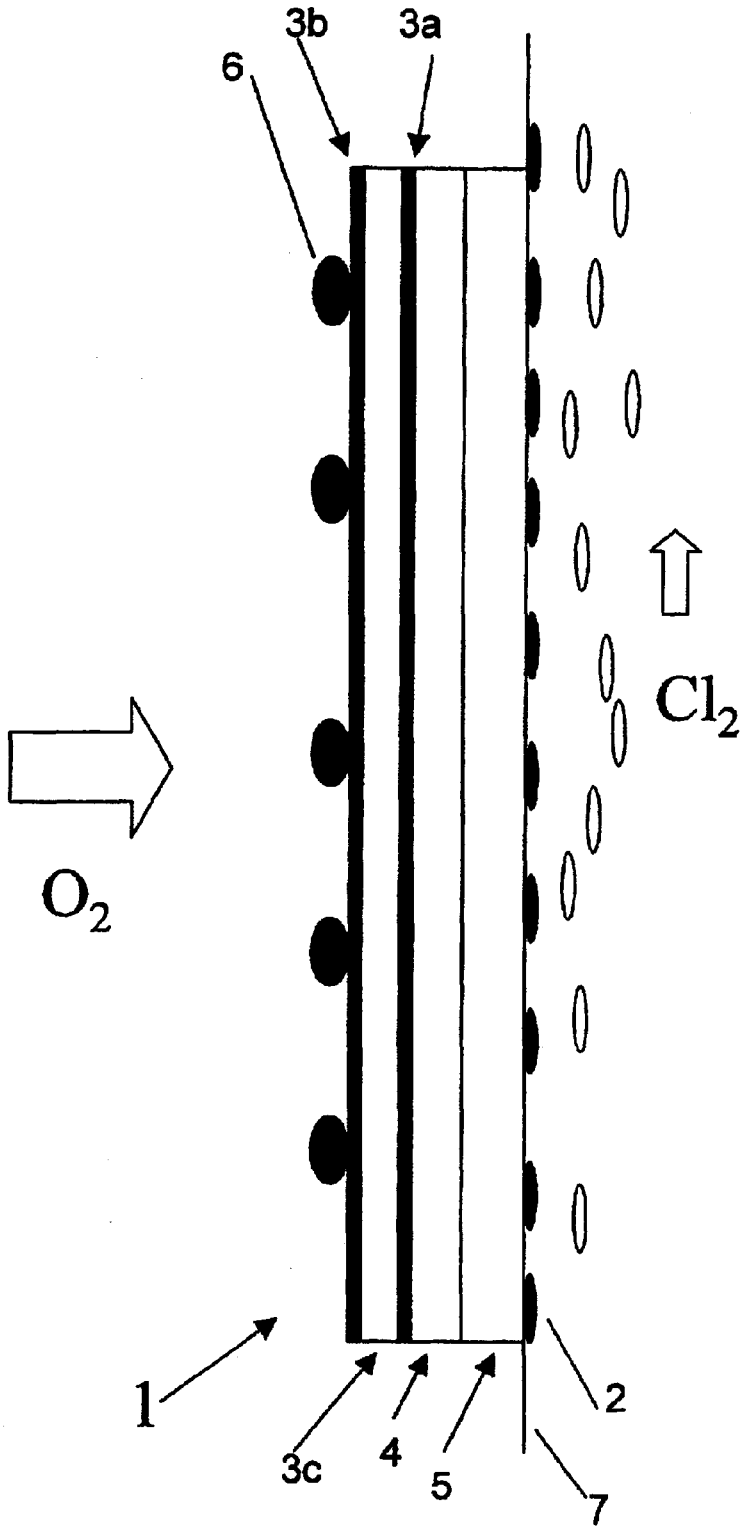
FIG. 1 is a side view of a gas diffusion electrode according to the invention.
Figure 2:
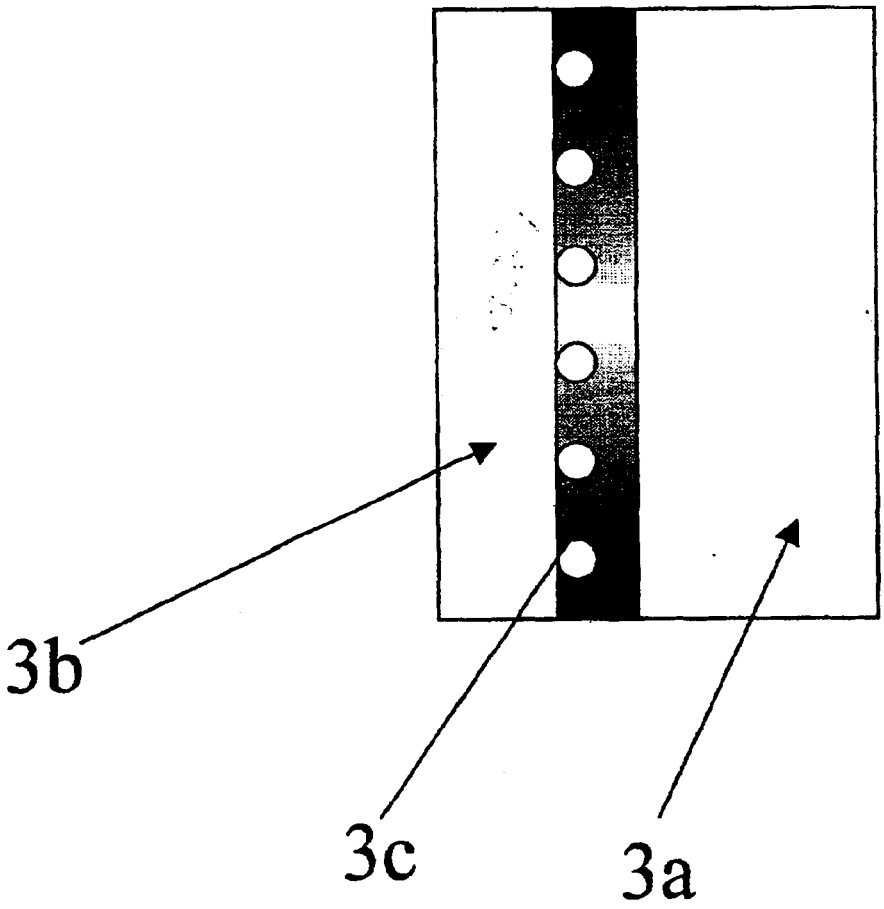
FIG. 2 is a cross section of a part of said gas diffusion electrode substrate.

Referring to the drawings, FIG. 1 refers to a gas diffusion electrode 1 arranged in an electrolytic cell (not shown) comprising a cathode compartment and an anode compartment partitioned by a separator 7. In the anode compartment is arranged an anode 2 attached to the separator 7. The gas diffusion electrode 1 comprising a hydrophilic layer 5, a barrier layer 4, a gas diffusion electrode substrate 3*c*, coated with a reaction layer 3*a*, and a hydrophobic gas diffusion layer 3*b*, is arranged to the separator 7 in the cathode compartment. A current collector 6 is electrically connected to the gas diffusion electrode 1. FIG. 2 shows a gas diffusion electrode substrate 3*c* attached to a reaction layer 3*a*. The gas diffusion electrode substrate is attached to a hydrophobic gas diffusion layer 3*b* on the opposite side of the reaction layer 3*a*.

The invention being thus described, it will be obvious that the same may be varied in many ways. Such variations are not to be regarded as a departure from the gist and scope of the present invention, and all such modifications as would be obvious to one skilled in the art are intended to be included within the scope of the claims. The following examples will further illustrate how the described invention may be performed without limiting the scope of it. If not otherwise specified, all percentages given herein concern percent by weight.

EXAMPLE 1

A 0.3 mm thick expanded silver mesh was prepared from a 0.1 mm thick silver plate, which was used as electrode substrate in a gas diffusion electrode. The gas diffusion electrode was subsequently manufactured in the following way:

1) A silver powder paste solution consisting of particles ranging from 0.5–1 $\mu$m was spread over a silver mesh, which was subsequently dried.
2) Following drying, the electrode substrate was sintered in air at a temperature of 450° C. for 30 minutes.
3) Dinitro diammine platinum salt dissolved in an alcohol solution, containing 50 g Pt/liter, was subsequently applied to one side of the prepared electrode substrate and baked at 350° C. in nitrogen gas atmosphere for 10 minutes, thereby forming a platinum-coated gas diffusion electrode.
4) 2-propyl tetrabuthoxi zirconium, i.e. $Zr(C_3H_5O)_4$ solution, was applied to the same substrate side as the platinum solution, whereafter the electrode was baked at 450° C. for 10 minutes. The procedure was repeated twice, whereafter a porous $ZrO_2$ barrier layer was obtained.
5) Subsequently, a PTFE solution was applied on the opposite side of the electrode substrate, whereafter the gas diffusion electrode was heated to 300° C. in air, thus resulting in a hydrophobic gas diffusion layer on the electrode substrate on the opposite side of the reaction layer. The formed PTFE layer was then smoothened by filing.

Electrolysis was performed in a circular electrolytic test cell having a diameter of 70 mm. The anode compartment was made of Pyrex™ and the cathode was made of Plexiglas™. Nafion™ 961 membrane from Dupont was used as cation exchange membrane in the electrolytic cell. The anode used was a DSA™ having an Ir/Ru/Ti oxide coating on a 1 mm thick expanded titanium mesh closely attached to the membrane. The fabricated gas diffusion electrode was closely attached to a hydrophilic carbon cloth available from Toho Rayon Company Limited, which was directly contacted to the membrane. A 1 mm thick silver-plated expanded nickel mesh, used as current collector, was closely contacted to the gas diffusion electrode. Draining holes were arranged on the lower part of the cathode compartment and the lower end of the carbon cloth was arranged to said holes. The electrolysis was performed at a salt concentration of 180 g/liter of NaCl solution at a pH of 3.5–4, which solution was circulated through the anode compartment. Water-saturated oxygen was supplied to the cathode compartment. The operating current density was 40 A/dm$^2$ and the temperature ranged between 88–92° C. The catholyte consisted of a 32–33 wt % NaOH solution. The cell voltage after 1000 hours of operation was 2.1 V. Neither flooding of the catholyte through the gas diffusion electrode nor any precipitation of formed sodium carbonate were observed.

EXAMPLE 2 (COMPARATIVE)

A gas diffusion electrode was prepared as in example 1 except that a $ZrO_2$ barrier layer was not attached to the platinum reaction layer. The electrolysis test was performed under the same conditions as in example 1. The test results showed that after 300 hours of operation of the electrolytic cell, flooding commenced at the hydrophobic part of the reaction layer. The cell voltage was 2.1 V. After 700 hours of operation, the flooding was considerable, and the cell voltage had raised to above 2.1 V. After 1000 hours of operation of the electrolytic cell, the cell was disassembled and the gas diffusion electrode was analysed. Precipitation of sodium carbonate could be observed on both the reaction layer and the hydrophobic gas diffusion layer, as a consequence of platinum being in contact with the hydrophilic layer, thereby catalysing the oxidation of the carbon cloth.

EXAMPLE 3

The gas diffusion electrode was made as in example 1. On the front surface of the reaction layer, a graphite carbon cloth available from Toho Rayon Company Limited was soaked in the zirconium dioxide solution of example 1 and attached to the gas diffusion electrode with the $ZrO_2$ side facing the reaction layer. The formed electrode was subsequently dried at 250° C. for 3 hours. The electrode was then heated to 450° C. in an oven for 30 minutes. Following heat treatment, the electrode was cooled to 25° C., PTFE solution was subsequently applied to the back surface of the gas diffusion electrode and baked at 250° C. for 30 minutes. A gas diffusion electrode having a porous hydrophilic layer was thereby obtained. The obtained gas diffusion electrode was submitted to the same electrolysis test as in example 1. The results showed a cell voltage of 2.02–2.05 V at a current density of 40 A/dm$^2$ at 90° C. No deterioration in electrolysis was observed after 1000 hours of electrolysis.

EXAMPLE 4

The expanded silver mesh of example 1 was used to manufacture a gas diffusion electrode. Silver paste comprising silver powder as of example 1, 20% PTFE (30 NE available from Dupont) was applied on the mesh to make it porous. On one side of the plate, an additional amount of 20% PTFE was applied. The obtained electrode was dried and heated to 200° C. for 10 minutes. It was subsequently pressed at 5 kg/cm$^2$ at 150° C. for 10 minutes. The electrode of the gas diffusion electrode was then coated with a hexachloro platinate 2-propyl alcohol solution on the opposite side of the PTFE side and subsequently heated at 300° C. for 30 minutes. A 90 wt % $ZrO_2$ paste comprising 10–20 $\mu$m $ZrO_2$ particles and 10 wt % PTFE (30 NE available from Dupont) were applied on the platinum side of the reaction layer followed by heating at 300° C. in air for 15 minutes. The obtained gas diffusion electrode was submitted to the electrolysis test under the same conditions as in example 1. The results were similar to example 1, the cell voltage after 1000 hours of operation being 2.07–2.12 V at a current density of 40 A/dm$^2$.

What is claimed is:

1. Gas diffusion electrode comprising a hydrophobic gas diffusion layer, a reaction layer, a barrier layer, and a hydrophilic layer arranged in the mentioned order.

2. Gas diffusion electrode according to claim 1, wherein an electrode substrate is arranged between the hydrophobic gas diffusion layer and the reaction layer.

3. Gas diffusion electrode according to claim 2, wherein the electrode substrate is made of silver or silver plated metals.

4. Gas diffusion electrode according to claim 1, wherein the barrier layer is substantially made of a ceramic material.

5. Gas diffusion electrode according to claim 4, wherein the ceramic material is at least one oxide and the at least one oxide is a zirconium oxide, titanium oxide, hafnium oxide or a mixture thereof.

6. Gas diffusion electrode according to claim 4, wherein the ceramic material is made of zirconium oxides.

7. Gas diffusion electrode according to claim 1, wherein the gas diffusion electrode is oxygen depolarised.

8. Method for manufacturing a gas diffusion electrode according to claim 1 comprising arranging a hydrophobic gas diffusion layer, a reaction layer, a barrier layer and a hydrophilic layer in the mentioned order.

9. Method according to claim 8, comprising arranging an electrode substrate in between the hydrophobic gas diffusion layer and the reaction layer.

10. Gas diffusion electrode comprising a hydrophobic gas diffusion layer, a reaction layer, a barrier layer, and a hydrophilic layer arranged in the mentioned order, and an electrode substrate being arranged between the hydrophobic gas diffusion layer and the reaction layer.

11. Gas diffusion electrode comprising a hydrophobic gas diffusion layer, a reaction layer, a barrier layer, and a hydrophilic layer arranged in the mentioned order, the barrier layer being made from a material of at least one oxide and the at least one oxide is a zirconium oxide, titanium oxide, hafnium oxide or a mixture thereof.

12. Electrolytic cell comprising an anode compartment and a cathode compartment partitioned by a separator, wherein a gas diffusion electrode comprising a hydrophobic gas diffusion layer, a reaction layer, a barrier layer, and a hydrophilic layer, arranged in the mentioned order, is arranged in the cathode compartment.

13. Process for the production of alkali metal hydroxide and chlorine in an electrolytic cell, said electrolytic cell comprising an anode compartment and a cathode compartment partitioned by a separator, wherein an anode is arranged in the anode compartment and a gas diffusion electrode comprising a hydrophobic gas diffusion layer, a reaction layer, a barrier layer, and a hydrophilic layer, arranged in the mentioned order, is arranged in the cathode compartment, said process comprising a) supplying an oxygen-containing gas to the cathode compartment b) supplying an aqueous solution of alkali metal chloride to the anode compartment c) passing an electric current through the electrolytic cell from the anode to the gas diffusion electrode thereby forming alkali metal hydroxide in the cathode compartment and chlorine in the anode compartment.

* * * * *